United States Patent [19]

Patterson

[11] 4,366,650

[45] Jan. 4, 1983

[54] SUPPORT ARRANGEMENT INCLUDING BASE SUPPORT MEANS AND ELEVATABLE SUPPORT MEANS TO TRANSPORT A DRAWWORKS AND DRILLING MAST SUPPORTED THEREON AND FOR POSITIONING AT A DRILLING LOCATION

[75] Inventor: Bradley C. Patterson, Spring, Tex.

[73] Assignee: PRE Corporation, Houston, Tex.

[21] Appl. No.: 175,058

[22] Filed: Aug. 4, 1980

[51] Int. Cl.[3] ..... E04H 12/34

[52] U.S. Cl. ..... 52/118; 254/86 H; 280/43.24; 414/10

[58] Field of Search ..... 414/10, 22, 919; 280/43.24; 254/86 H; 173/23, 28, 151; 52/116, 118, 120; 212/182, 184, 189

[56] References Cited

U.S. PATENT DOCUMENTS

| | | | |
|---|---|---|---|
| 2,817,495 | 12/1957 | Pearl | 173/23 |
| 3,101,816 | 8/1963 | Fox | 212/184 X |
| 3,166,298 | 1/1965 | Di Stefano | 254/86 H |
| 3,754,361 | 8/1973 | Branham et al. | 52/116 X |
| 3,807,109 | 4/1974 | Jenkins et al. | 173/151 X |
| 3,860,216 | 1/1975 | Brown | 254/86 H |

FOREIGN PATENT DOCUMENTS

| | | | |
|---|---|---|---|
| 508465 | 12/1954 | Canada | 52/116 |
| 2027197 | 12/1971 | Fed. Rep. of Germany | 173/23 |
| 2834811 | 2/1980 | Fed. Rep. of Germany | 212/189 |

*Primary Examiner*—Leslie J. Paperner
*Attorney, Agent, or Firm*—Jack W. Hayden

[57] ABSTRACT

An arrangement to support a drawworks and drilling mast in elevated position during drilling operations and which also functions to transport the drawworks and drilling mast includes a base support and an elevated support with jacks pivotally conncted to the base support and the elevatable support and extending herebetween. Wheels are mounted on the elevatable support for transporting the base support elevatable support, the drilling mast and drawworks carried on the elevatable support. Brace members are pivotally connected between the base support and elevatable support to retain the elevatable support in elevated position during drilling operations. A support including an A-frame retains the drilling mast in generally a horizontal position on the arrangement during transport and the drilling mast is pivotally connected to the A-frame intermediate the ends of the drilling mast whereby the foot of the drilling mast may be moved about the A-frame and secured at its lower end to the base support to retain the drilling mast in an erect position for conducting drilling operations.

2 Claims, 3 Drawing Figures

SUPPORT ARRANGEMENT INCLUDING BASE SUPPORT MEANS AND ELEVATABLE SUPPORT MEANS TO TRANSPORT A DRAWWORKS AND DRILLING MAST SUPPORTED THEREON AND FOR POSITIONING AT A DRILLING LOCATION

SUMMARY OF THE INVENTION

Various types of trailer mounted drawworks and drilling mast arrangements have been heretofore provided, particularly where the mast is to be positioned so that its working floor is relatively close in proximity to the earth's surface. However, some drilling mast arrangements now provide a working floor which is elevated substantially relative to the earth's surface and it has been generally customary to transport the support means for the drilling mast, the drilling mast as well as support means for drawworks and the drawworks on trailer means whereupon the drilling mast support means is positioned on the earth's surface. The drawworks support means, drawworks and mast are then elevated to a desired position relative to the mast support means to conduct drilling operations. When the operation is complete, the drilling mast is dismantled and lowered and the drawworks and its support lowered to ground level and they along with the support means for the drilling mast are then reloaded onto trailer means and moved to another drilling location.

An object of the present invention is to provide a base support means and an elevatable support means which are provided with wheel means to form a trailer to transport drawworks means and a drilling mast thereon. Suitable power means interconnect the base support means and elevatable support means to enable the base support means to be lowered relative to the elevatable support means and positioned on the earth's surface whereupon the power means may be further actuated to elevate the support means with the drawworks and telescoping drilling mast thereon into a vertical spaced relationship relative to the base support means. The drilling mast is supported on the elevatable support means during transport by support means including A-frame means. After the elevatable support means has been elevated by any suitable means with the drawworks means and drilling mast means thereon, the drilling mast may be pivoted about its A-frame support by any suitable means to an erect position to enable drilling operations to be conducted.

After the drilling operations have been completed, the drilling mast may then again be pivoted about the A-frame into a horizontal position and telescoped whereupon the power means interconnecting the base support means and elevatable support means may be actuated to lower the elevatable support means with the drawworks and telescoped mast thereon to a position adjacent the earth's surface so that wheel means carried thereby engage the earth's surface. The power means is actuated to lift the base support means off the ground and maintain it elevated adjacent the elevated means supported by the wheel means which rests on the earth's surface. The wheel means supporting the base support means and elevatable support means then enable the collapsed arrangement to be moved by any suitable vehicle means to another location.

Other objects and advantages of the present invention will become more readily apparent from a consideration of the following description and drawings.

DESCRIPTION OF THE PREFERRED EMBODIMENT

Figure 1:
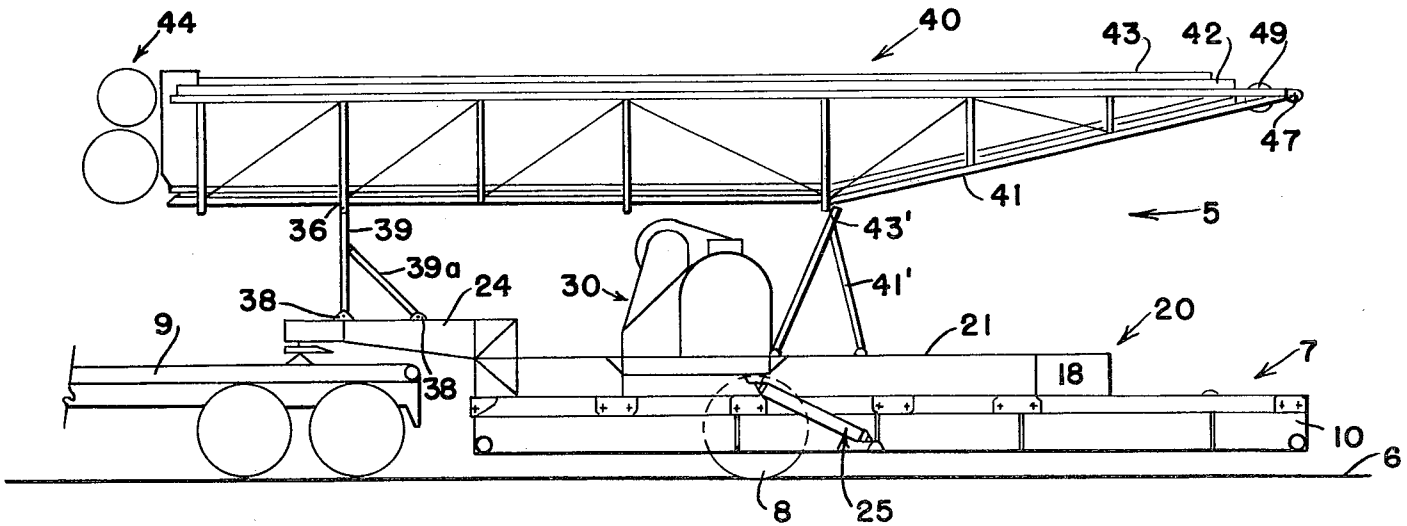
FIG. 1 is a schematic side view illustrating the arrangement of the present invention in collapsed position ready to be transported by suitable vehicle means.

Attention is first directed to FIG. 1 of the drawings wherein the present invention is referred to generally by the numeral 5. It can be seen that the longitudinal base support means referred to generally by the numeral 7 and the elevatable support means referred to generally by the numeral 20 are juxtaposed with the base support means beneath, and adjacent the elevatable support means 20, but in elevated position relative to the earth's terrain or surface 6 by reason of the support wheels 8.

The base support means 7 and elevatable support means 20 thus cooperate to form a trailer means to enable the drawworks referred to generally at 30 and the telescoped mast referred to generally at 40 which are supported on the elevatable support means 20 to be transported by means of the foregoing arrangement from one location to another by any suitable vehicle such as that referred to at 9.

It can be appreciated that the base support means 7 includes a pair of laterally spaced longitudinally extending beams one of which is shown at 10. Suitable laterally extending members (not shown) between the spaced longitudinally extending beams 10 retain them in spaced arrangement and provide structural support. The elevatable support means 20 includes laterally spaced members 18, one of which can be seen in the drawings, with laterally extending beams (not shown) extending therebetween. A surface 21 is provided on the members 18 and lateral means therebetween which forms a floor surface that provides a working floor area at a desired elevation in the mast 40 when it is in erect position. Such floor also supports the drawworks 30 and mast support means on elevatable support means 20 as will be described.

Figure 2:
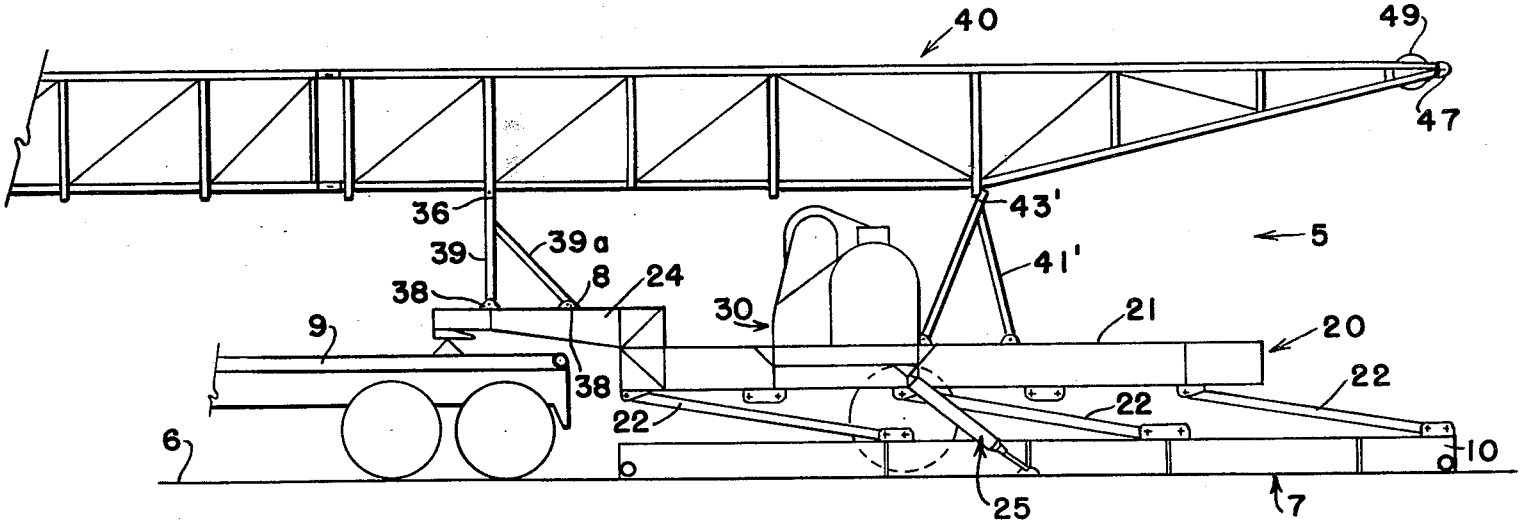
FIG. 2 illustrates schematically in side view the details of the present invention when it is positioned at a drilling location with the base support means lowered into position to engage the earth's surface.

FIG. 2 shows the arrangement 5 of the present invention as it is being positioned on the earth's surface 6 at a drilling location. It will be noted that the base support means 7 and elevatable support means 20 are interconnected by suitable power means referred to at 25 which may be of any suitable type. As illustrated, such power means 25 is shown as being in the form of double-acting hydraulic jack means, and it can be appreciated that at least one of such devices is connected on each side to the longitudinal members 18 of the elevatable means 20 and on each side to the longitudinal base beam members 10 of the base support means as shown in FIG. 2.

The base support means may be lowered onto the earth's surface represented at 6 by the power means 25, if desired, or the power means deactivated to permit the base support means to lower by gravity onto the earth's surface 6.

The telescoping mast 40 is supported in any suitable manner on the elevatable support means at 20 and preferably such support means includes the A-frame 41' and the vertical brace member 39 spaced from A-frame 41' as shown. The drilling mast is connected as represented at 43' to the top of the A-frame means 41' which connection includes a pivot arrangement to enable the mast 40 to be moved to erect position when desired.

Figure 3:
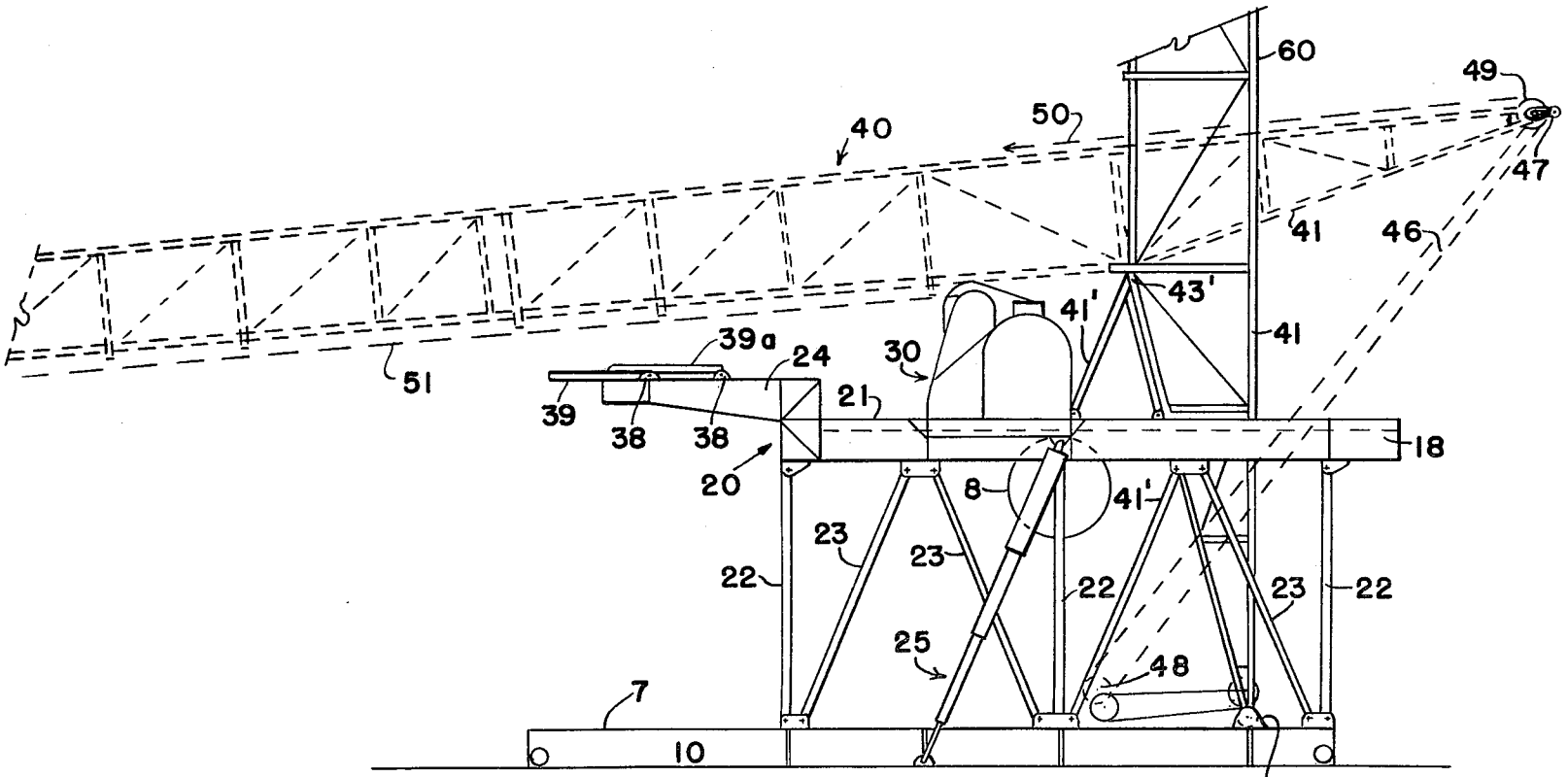
FIG. 3 is a schematic side view similar to FIG. 2 and illustrating the elevated support means in elevated vertical, spaced relation to the base support means with the drilling mast illustrated in dotted line ready to be moved to an erect position and showing the mast in erect position in full line, ready to conduct drilling operations.

After the base support means 7 has been lowered onto the earth's surface 6 as shown in FIG. 2 of the drawings by the power means 25, or as otherwise described herein, the vehicle 9 may be disconnected from the arrangement 5 of the present invention. Thereafter, the elevatable support means 20 may be moved to final position by actuation of the power means 25. The base support means 7 and the elevatable support means 20 are also pivotally interconnected by the brace members 22 as better seen in FIGS. 2 and 3 of the drawings. Brace means or members 22 are connected to each side of each of the base support means 7 and elevatable support means 20. Actuation of the power means 25 is continued until the elevatable support means 20 assumes its final elevated position as shown in FIG. 3 which is vertically spaced relative to the base support means 7. At that time additional braces as illustrated at 23 may be provided between the base support means 7 and the elevatable support means 20 to further brace and strengthen the structure for conducting drilling operations.

Also, at such time the drawworks 30 is in its final elevated position and the drilling mast 40 may be positioned to conduct drilling operations.

As shown in FIG. 1 of the drawing, the drilling mast 40 is telescoped and includes a bottom section 41 having an intermediate section 42 telescoped therein with a top section 43 telescoped in the intermediate section 42. A crown block referred to schematically at 44 in FIG. 1 is carried on the top section 43 in a manner well known in the art.

If desired, after the base support means 7 has been positioned on the earth's surface 6 as shown in FIG. 2 of the drawings, the telescoped sections 42 and 43 may be moved longitudinally relative to the section 41 in a manner well known and secured in position as partially illustrated in FIG. 2 of the drawings. Thereupon, the drilling mast 40 is ready to be moved to an erect position.

It can be seen in FIG. 3 that the support bracket 39 is connected at 36 to the mast 40, and the bracket **39*a*, along with bracket 39, support the telescoped drilling mast 40 during transport of the arrangement 5. The bracket 39 may be disconnected from the drilling mast and lowered to an inactive position as illustrated in FIG. 3 of the drawing. To accomplish this, the bracket 39*a* connecting with the vertically extending support 39 may be disconnected therefrom. Both the member 39 and the member 39*a* are pivotally connected as represented at 38 to an extension 24 of the elevatable support means 20, and when the member 39 is disconnected from the mast, and the member 39*a* disconnected from the member 39 they will drop to the position shown in FIG. 3** of the drawings.

Prior to disconnecting the member 39, suitable means such as cable means 46 shown in dotted line in FIG. 3 may be secured adjacent the foot 47 of the mast 40. The cable means 46 then extends downwardly and around sheave means 48 positioned adjacent the beam means 10 of the base support means 7 and then around sheave means 49 adjacent the foot of the mast and then extends to be connected as represented at 50 to the traveling block (not shown) in the drilling mast 40. This forms a sling means to assist in elevating mast 40, and holding it in position when brackets 39, **39*a* are disconnected and prior to elevating the mast 40. Cable means (not shown) extend between the crown block 44 and the traveling block (not shown) in a manner well known in the art with a line extending from the crown block to the drawworks as illustrated in dotted line at 51. When the drum on the drawworks is actuated, a tension is placed on the cable 51 to pull the traveling block and move it upwardly (to the left as viewed in FIG. 3) of the derrick 40 when the derrick 40 is in the dotted line position as shown in FIG. 3. Continued rotation of the drawworks drum winds the cable 51 thereon and moves the travelling block to the left of the extended mast 40 as viewed in FIG. 3. As the cable 51 is wound on the drawworks drum, the sling line between the traveling block and the foot 47 tends to maintain or restrain the travelling block and causes mast 40 to pivot about A-frame 41 to an erect position as represented in full line at 60 of FIG. 3. Thereupon the lower end of the lowermost section 41 of mast 40 may be secured in the bracket or footing 56 carried on the beams 10 to retain the mast 40** in vertical position.

Thereafter, drilling operations may be conducted in a manner well known in the art. The mast sections 42 and 43 are extended from mast section 41 in a manner well known before the mast 40 is moved to the erect position as described above.

When drilling of the well has been completed, it can be appreciated that a minimum amount of time is lost in positioning the drilling arrangement of the present invention for transport to a new location. It should be noted that the wheel means 8 as shown in the drawings are rotatably mounted in any suitable manner on the elevatable support means. Such wheel means could be rotatably supported by any suitable bracket means mounted on the base support means 7 as desired. At any event, as shown in FIG. 3 of the drawings when the elevatable support means 20 are elevated, the wheels 8 on each side thereof are also elevated.

In dismantling the present arrangement for transport to a new location, the foregoing procedure is reversed. First of all the mast is lowered from an erect position to the dotted line position shown in FIG. 3. Thereafter, the mast is telescoped so that the section 43 and 42 move within the lower most section 41 and the section 41 is engaged by the support member 39. Thereafter, the power means 25 is actuated to lower the elevatable support means 20 to the position shown in FIG. 2 and the power means is then actuated to elevate and hold the base support means 10 as shown in FIG. 1.

When the base support means 7 and elevatable support means 20 with the drawworks 30 and telescoped mast 40 thereon are in the position shown in FIG. 1, the extension 24 may be connected in a manner well known in the art to a vehicle 9 for transport.

It will be noted that the elevatable support means 20, by incorporating the A-mast 41' thereon as part of the support means for the drilling mast 40 when in telescoped position as shown in FIG. 1 enables the drilling mast 40 to be readily moved from a horizontal to an erect position and from an erect to a horizontal position by tilting or pivoting the mast about its connection 43' on the A-frame 41' as described hereinbefore and as illustrated in FIG. 3 of the drawings. Also, the arrangement is self contained in that the base support means 7 and elevatable support means 20 form trailer means to transport the drawworks 30 and mast 40 and also serve as the support means therefor on a drilling location.

The foregoing disclosure and description of the invention are illustrative and explanatory thereof, and various changes in the size, shape, and materials as well as in the details of the illustrated construction may be made without departing from the spirit of the invention.

What is claimed is:

1. An arrangement which forms the support for an elevated drilling means and drawworks during drilling operations and which also collapses to form a transportable arrangement for the drilling mast and drawworks comprising:

a. elevatable support means;

b. support means on said elevatable support means supporting the drilling mast means in a longitudinally extending relationship during transport, said support means including:

A-frame means mounted on said elevatable support means and pivotally connected at its upper end to said longitudinally extending drilling mast at a position laterally spaced from the foot of the drilling mast;

c. wheel means connected to said elevatable support means for transport of the arrangement and supported drilling mast and drawworks;

d. base support means;

e. means extending between and pivotally connected to each said elevatable support means and said base support means whereby said base support means may be positioned adjacent the elevatable support means during transport and may be lowered onto the earth's surface at a well location;

f. jack means pivotally connected to and extending between each said base support means and elevatable support means for elevating said elevatable support means with the drawworks and drilling mast supported on the A-frame; and g. means to pivot said drilling mast about said A-frame whereby the foot of the drilling mast may be swung downwardly and secured to said base support means to retain the drilling mast in an erect position during drilling operations.

2. The arrangement of claim 1 wherein said means to pivot said drilling mast to lower the foot thereof for connection to said base support means includes:

a. first sheave means positioned adjacent said base support means;

b. second sheave means positioned adjacent the foot of said drilling means;

c. first cable means secured at one end adjacent the foot of the drilling mast and extending downwardly over said first sheave means and then upwardly over said second sheave means with the other end of the cable means connected to the drilling mast travelling block; and d. second cable means extending from the elevated drawworks to the drilling mast crown block whereby actuation of the drawworks places a tension in said first and second cable means to pivot the reclined drilling mast on the elevatable support means about said A-frame so that the foot of the drilling mast moves downwardly to said base support means for connection therewith.

* * * * *